US011041357B2

(12) United States Patent
Pounds, Jr.

(10) Patent No.: US 11,041,357 B2
(45) Date of Patent: Jun. 22, 2021

(54) ANNULAR BYPASS PACKER

(71) Applicant: Halliburton Energy Services, Inc., Houston, TX (US)

(72) Inventor: Steve Robert Pounds, Jr., Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 166 days.

(21) Appl. No.: 16/301,960

(22) PCT Filed: Jul. 21, 2017

(86) PCT No.: PCT/US2017/043361
§ 371 (c)(1),
(2) Date: Nov. 15, 2018

(87) PCT Pub. No.: WO2019/017973
PCT Pub. Date: Jan. 24, 2019

(65) Prior Publication Data
US 2020/0256151 A1 Aug. 13, 2020

(51) Int. Cl.
*E21B 33/12* (2006.01)
*E21B 33/122* (2006.01)
(Continued)

(52) U.S. Cl.
CPC ..... *E21B 33/122* (2013.01); *E21B 33/1216* (2013.01); *E21B 43/16* (2013.01); *E21B 43/14* (2013.01)

(58) Field of Classification Search
CPC .... E21B 33/1216; E21B 33/122; E21B 43/14; E21B 43/16
See application file for complete search history.

(56) References Cited

U.S. PATENT DOCUMENTS 6,298,916 B1 * 10/2001 Tibbles ..... E21B 41/00 166/278
6,481,503 B2 * 11/2002 Hamilton ..... E21B 43/162 166/313

(Continued)

FOREIGN PATENT DOCUMENTS

WO 2014124533 A1 8/2014
WO 2015038635 A2 3/2015

OTHER PUBLICATIONS

International Search Report and Written Opinion dated Jun. 26, 2018; International PCT Application No. PCT/US2017/043361.

*Primary Examiner* — Matthew R Buck
(74) *Attorney, Agent, or Firm* — McGuireWoods LLP

(57) ABSTRACT

A system for facilitating fluid flow to a wellbore includes a packer having a first conduit and a second conduit adjacent to the first conduit. A portion of the second conduit is formed by an outer surface of the first conduit. The packer also includes a swelling element that surrounds and radially encloses the first conduit and second conduit. The first end of the packer includes a bulkhead manifold having a transition section that forms a fluid coupling from at least one external bypass conduit to the second conduit, and the swelling element is operable to form a seal against a wellbore wall upon exposure to a swell fluid. The first end of the packer is fluidly coupled to the fluid supply source via an external bypass conduit, and the second conduit is fluidly coupled to the annulus of the wellbore at the second end of the annulus bypass packer.

20 Claims, 6 Drawing Sheets

(51) Int. Cl.
*E21B 43/14* (2006.01)
*E21B 43/16* (2006.01)

(56) References Cited

U.S. PATENT DOCUMENTS

| | | | | |
|---|---|---|---|---|
| 7,784,532 | B2 * | 8/2010 | Sevre | E21B 33/1208 166/51 |
| 9,010,417 | B2 * | 4/2015 | Garcia | E21B 43/04 166/236 |
| 9,428,997 | B2 * | 8/2016 | Broussard | E21B 43/04 |
| 2002/0162667 | A1 | 11/2002 | Ingram et al. | |
| 2002/0189809 | A1 | 12/2002 | Nguyen et al. | |
| 2008/0066900 | A1 * | 3/2008 | Saebi | E21B 33/1208 166/51 |
| 2009/0008084 | A1 * | 1/2009 | Dybevik | E21B 43/08 166/228 |
| 2009/0294128 | A1 | 12/2009 | Dale et al. | |
| 2010/0155064 | A1 * | 6/2010 | Nutley | E21B 33/1208 166/278 |
| 2012/0217010 | A1 * | 8/2012 | Haeberle | E21B 33/1208 166/278 |
| 2016/0186544 | A1 * | 6/2016 | Greci | E21B 43/14 166/305.1 |

* cited by examiner

ANNULAR BYPASS PACKER

BACKGROUND

The present disclosure relates to oil and gas exploration and production, and more particularly to a production system for use in extracting hydrocarbons from a geological formation.

During the operation of a well, it may be desirable to isolate portions of the well from one another such that certain segments, or zones, of the well are not in direct fluid equilibrium with one other. To provide such isolations, one or more packers may be placed along segments of a workstring to form a relative seal across the annulus formed by the external surface of the workstring and the wall of the wellbore.

SUMMARY

The present disclosure relates to oil and gas exploration and production, and more particularly to a production system for use in extracting hydrocarbons from a geological formation.

In accordance with a first illustrative embodiment, a packer includes a first conduit extending from a first end of the packer to a second end of the packer, and a second conduit adjacent to the first conduit. A portion of the second conduit is formed by an outer surface of the first conduit. The packer further includes a swelling element surrounding the first conduit and second conduit. The first end of the packer includes a bulkhead manifold having a transition section forming a fluid coupling from at least one external bypass conduit to the second conduit. The swelling element is operable to form a seal against a wellbore wall upon exposure to a swell fluid.

In accordance with a second illustrative embodiment, a system for facilitating fluid flow to a wellbore includes a fluid supply source that is fluidly coupled to an annulus of a wellbore and a packer. The packer has a first conduit extending from a first end of the packer to a second end of the packer and a second conduit adjacent to the first conduit. A portion of the second conduit is formed by an outer surface of the first conduit. The packer also includes a swelling element that surrounds and radially encloses the first conduit and second conduit. The first end of the packer includes a bulkhead manifold having a transition section that forms a fluid coupling from at least one external bypass conduit to the second conduit, and the swelling element is operable to form a seal against a wellbore wall upon exposure to a swell fluid. The first end of the packer is fluidly coupled to the fluid supply source via an external bypass conduit, and the second conduit is fluidly coupled to the annulus of the wellbore at the second end of the annulus bypass packer.

In accordance with another illustrative embodiment, a method of providing fluid flow to a wellbore includes supplying a fluid to an annulus of a wellbore from a fluid supply source. The method also includes supplying fluid to a first end of a packer. The packer has a first conduit extending from the first end of the packer to a second end of the packer and a second conduit adjacent to the first conduit. A portion of the second conduit is formed by an outer surface of the first conduit. The packer also includes a swelling element surrounding the first conduit and second conduit. The first end of the packer includes a bulkhead manifold having a transition section forming a fluid coupling from at least one external bypass conduit to the second conduit. The swelling element of the packer is operable to form a seal against a wellbore wall upon exposure to a swell fluid. The first end of the packer is fluidly coupled to the fluid supply source via an external bypass conduit, and the second end of the packer is fluidly coupled to an injection zone of the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF ILLUSTRATIVE EMBODIMENTS

Figure 1:
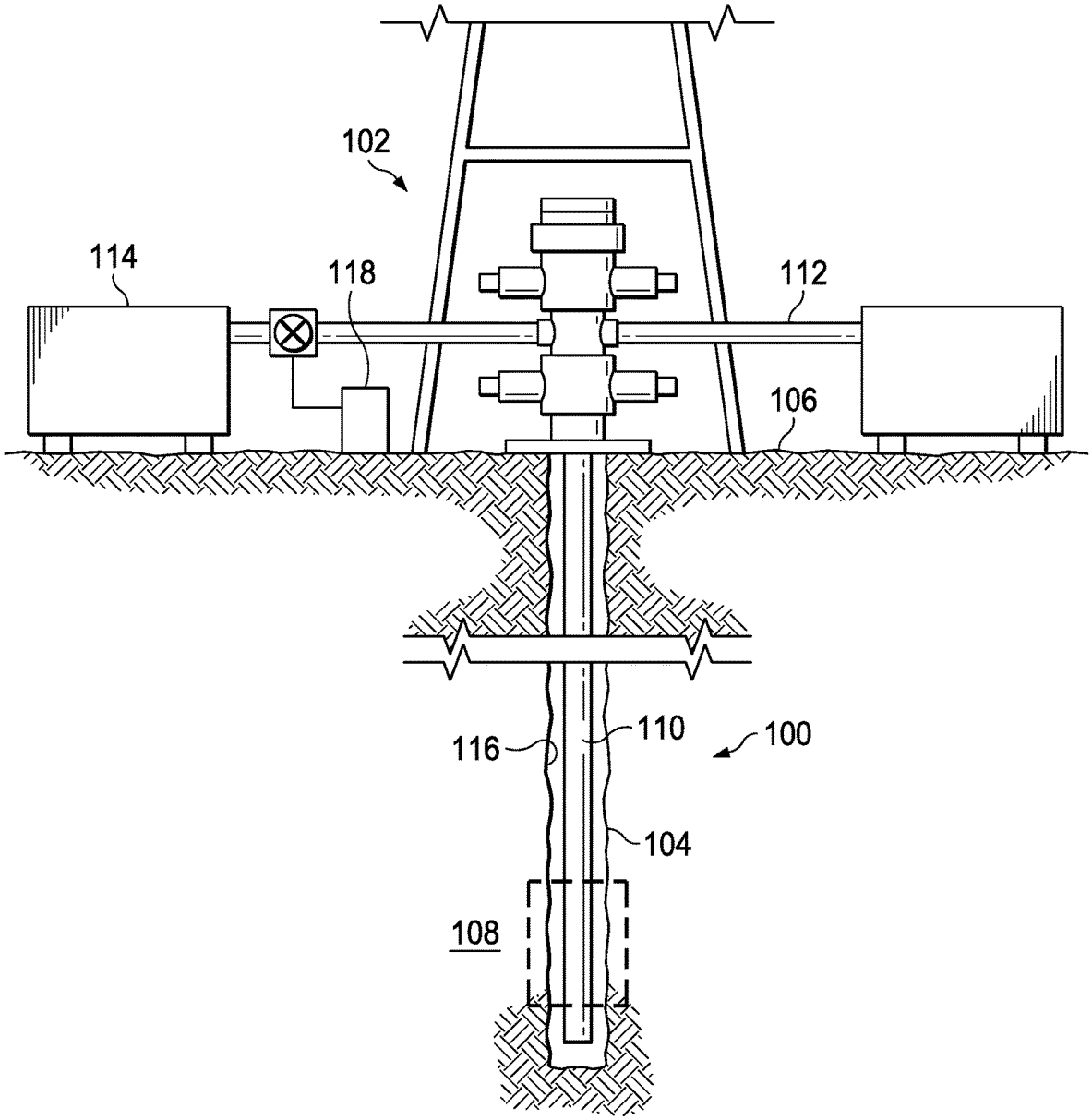
FIG. 1 illustrates a schematic view of an on-shore well having a production system according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention.

To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to a packer having an annular bypass feature that provides for the passage of a fluid pathway from one zone of a wellbore to the next to selectively provide for delivering a pressurized fluid to the zone or isolating the zone from the pressurized fluid.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

While a portion of a wellbore may in some instances be formed in a substantially vertical orientation, or relatively perpendicular to a surface of the well, the wellbore may in some instances be formed in a substantially horizontal orientation, or relatively parallel to the surface of the well, the wellbore may include portions that are partially vertical (or angled relative to substantially vertical) or partially horizontal (or angled relative to substantially horizontal). In some wellbores, a portion of the wellbore may extend in a downward direction away from the surface and then back up toward the surface in an "uphill," such as in a fish hook well. The orientation of the wellbore may be at any angle leading to and through the reservoir.

Figure 2:
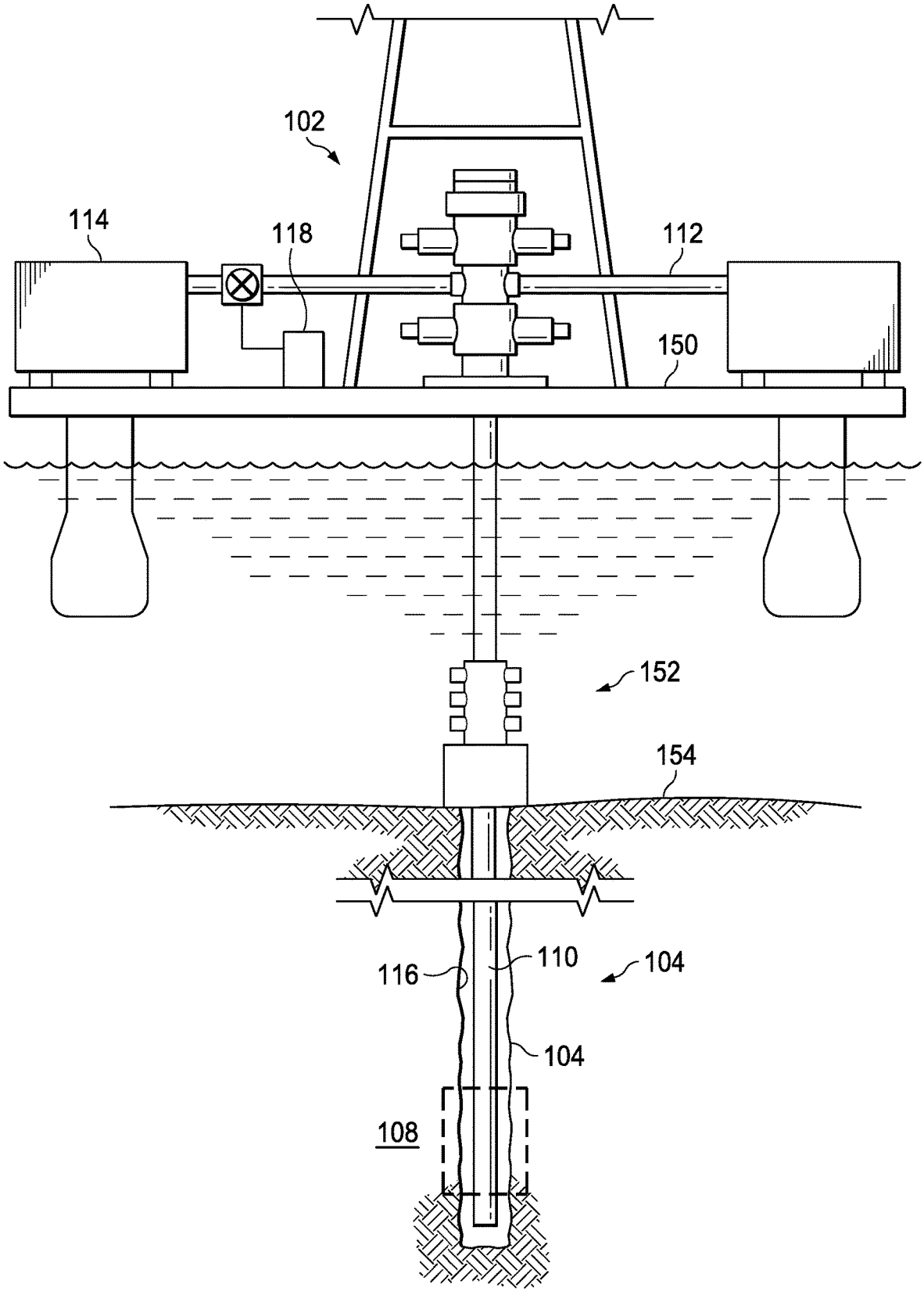
FIG. 2 illustrates a schematic view of an off-shore well having a production system according to an illustrative embodiment.

Referring now to the figures, FIG. 1 illustrates a schematic view of a well 100 operating a production system 102 according to an illustrative embodiment. The well 100 includes a wellbore 104 that extends from the surface 106 of the well 100 to a subterranean substrate or formation 108. The well 100 and production system 102 are illustrated onshore in FIG. 1. Alternatively, FIG. 2 illustrates a schematic view of an offshore platform 150 operating the production system 102 according to an illustrative embodiment. The production system 102 in FIG. 2 may be deployed in a sub-sea well 152, shown in FIG. 2, accessed by the offshore platform 150, shown in FIG. 2. The offshore platform 150 may be a floating platform or may instead be anchored to a seabed 154, shown in FIG. 2. It is noted that while the illustrated embodiments of FIGS. 1 and 2 contemplate a system in which injection fluid may be delivered to a wellbore via the workstring 110 or annulus 116 (as described in more detail below), in other embodiments it may be preferable to delivery injection fluid via a second tube run into the annulus 116.

In the embodiments illustrated in FIGS. 1 and 2, the wellbore 104 has been formed by a drilling process in which dirt, rock and other subterranean material is removed to create the wellbore 104. During or after the drilling process, a portion of the wellbore may be cased with a casing (not illustrated). In other embodiments, the wellbore may be maintained in an open-hole configuration without casing. The embodiments described herein are applicable to either cased or open-hole configurations of the wellbore 104, or a combination of cased and open-hole configurations in a particular wellbore.

After drilling of the wellbore is complete and the associated drill bit and drill string are "tripped" from the wellbore 104, a workstring 110, shown as a production string, is lowered into the wellbore 104. The workstring 110 may include sections of tubing, each of which are joined to adjacent tubing by threaded or other connection types. The work string may refer to the collection of pipes or tubes as a single component, or alternatively to the individual pipes or tubes that comprise the string. The term work string (or tubing string or production string) is not meant to be limiting in nature and may refer to any component or components that are capable of being coupled to the production system 102 to lower or raise the production system 102 in the wellbore 104 or to provide energy to the production system 102 such as that provided by fluids, electrical power or signals, or mechanical motion. Mechanical motion may involve rotationally or axially manipulating portions of the workstring 110. In some embodiments, the workstring 110 may include a passage disposed longitudinally in the workstring 110 that is capable of allowing fluid communication between the surface 106 of the well 100 and a downhole location.

The production system 102 may include a fluid collection system 112 for receiving fluid extracted from the formation 108 via the workstring 110. The production system 102 may also include a fluid delivery system 114 having a fluid supply source that may be used to, for example, apply a pressurized fluid to at least a portion of an annulus 116 formed between the external surface of the workstring 110 and the internal wall of the wellbore 104. As described in more detail below, in some production environments, it may be desirable to apply a pressurized fluid to a segment, or zone of the well 100 while simultaneously extracting fluid from another zone of the well 100. To that end, the production system 102 may include a controller 118 that is controlled by remote or local operator or control system to control the functions of the production system 102 (e.g., to facilitate the production of fluid from the workstring 110 or the application of fluid to the annulus 116).

Figure 3:
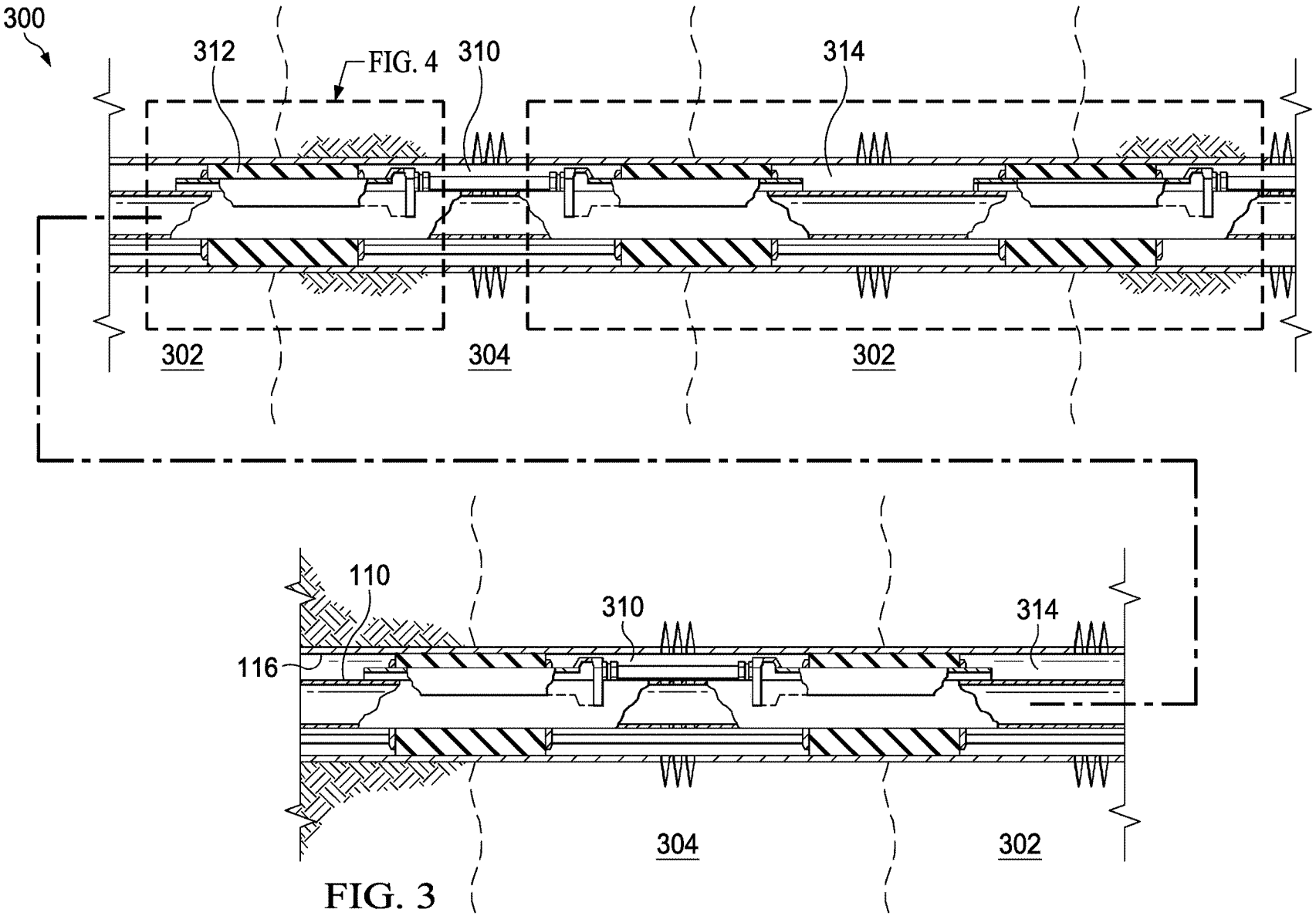
FIG. 3 is a detail view of a portion of the production system of FIG. 1.

FIG. 3 shows a detail view of a portion of the workstring 110 that spans multiple zones of the formation 108 and, more particularly, a subsystem 300 for selectively applying a pressurized fluid to the annulus 116. For illustrative purposes, the formation 108 is shown as including alternating injection zones 302, in which a pressurized fluid is applied to the formation 108 via the annulus 116, and production zones 304 in which wellbore fluids are harvested from the formation 108 by allowing fluid to pass from the formation 108 across the annulus 116 and through a screen or perforations in the workstring 110, or through a manually or remotely operated sleeve that selectively allows production fluid into the workstring 110. In the injection zones 302, the workstring 110 includes a first tubing interval 314 that facilitates the injection of fluids to the formation 108. Correspondingly, in the production zones 304, the workstring 110 includes a second tubing interval 310 that facilitates collection of fluid from the formation 108. To fluidly isolate the portions of the annulus 116 that adjoin each injection zone 302 from those that adjoin each production zone 304, a packer 312 is positioned between each zone to form a seal between the internal wall of the wellbore 104 and the external surface of the workstring 110. In the case of an isolation zone, the injection fluid may be restricted from flowing into the zone and wellbore fluid may be restricted from flowing into the workstring. In the case of an injection zone 302, injection fluid may be supplied to the injection zone 302 via the annulus 116. Alternatively, injection fluid may be supplied via a bypass opening in the workstring 110, which could be automatically or manually controlled. In the case of a controlled opening, control may be facilitated via optional control lines. Such control lines could be independently routed through the packer, or routed through the bulkhead connection and bypass conduit, as described in more detail below.

Each such packer 312 may be a swell packer that comprises an elastomer or similar expandable material that is selected or configured to expand upon being exposed to a target fluid, which may be a fluid from the formation 108 or a fluid delivered to the wellbore by an operator.

In an illustrative embodiment, the packer 312 may be a single manifold, annular bypass packer that includes a manifold interface at a first end, and facilitates the passage of fluid across a sealing element of the packer 312 from an uphole portion of the annulus to a downhole portion of the annulus (or vice versa). In another illustrative embodiment, the packer 312 may be a dual-manifold packer that includes a manifold interface at each end of the packer 312, and also facilitates an annular bypass of the sealing element of the packer 312. As referenced herein with respect to elements in a wellbore, "uphole from" means closer to the surface of the well, taken along the path of the wellbore, and "downhole from" means further away from the surface of the well, taken along the path of the wellbore.

Figure 4:
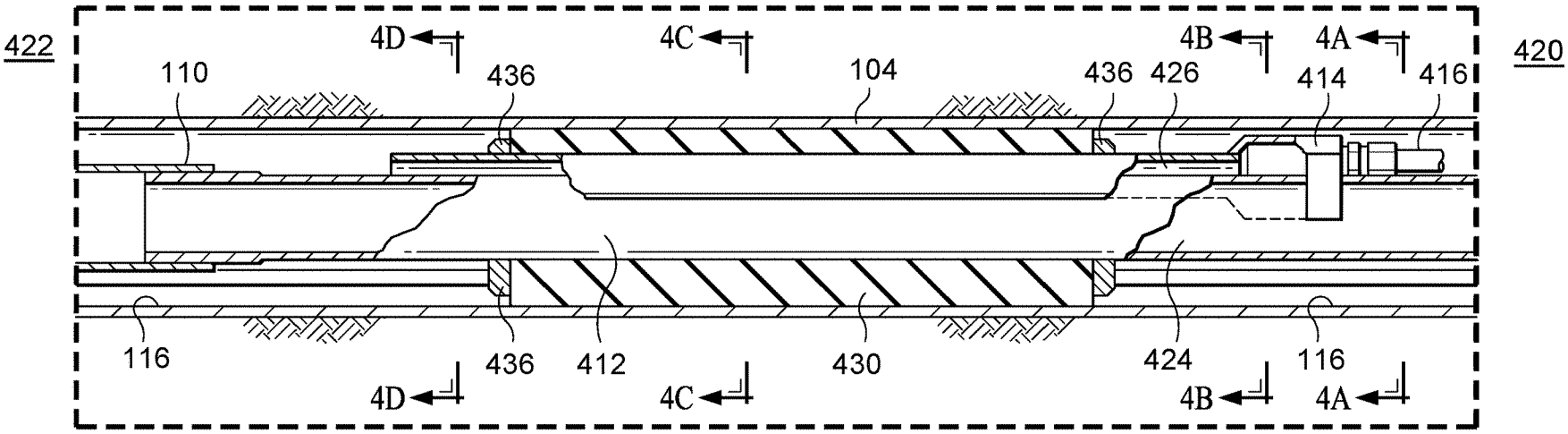
FIG. 4 is a detail view of a single-manifold annular bypass packer deployed in the production system shown in FIGS. 1-3.

An example of a single manifold embodiment is described in more detail with regard to FIG. 4 and cross-sections 4A-4D. Here, the annular bypass packer 412 is shown as isolating a production zone at a first end 420 from an injection zone at a second end 422 of the annular bypass packer 412. The annular bypass packer 412 includes a central conduit 424, which may be referred to as a first conduit that is fluidly coupled to a primary flow path of the workstring 110. The central conduit 424 may be formed from a tubing segment and extends from the first end 420 of the packer to the second end 422 of the packer 412 to convey fluid through the workstring 110. The packer 412 also includes a second conduit 426 that is operable to convey fluid along the annulus 116, outside of the primary flow path (and associated central conduit 424). The second conduit 426 may be formed by enclosing an area that borders the central conduit 424 thereby using an outer boundary of the central conduit 424 to form the second conduit 426. More particularly, the second conduit 426 may be formed by cutting a second tubing segment and joining the cut tubing to an external surface of tubing that forms the primary conduit 424. In some embodiments, the cut tubing may be tubing that has a similar diameter to tubing of the central conduit 424 in half, and seam-welding the half tube to the exterior of the tubing of the central conduit 424.

Both the central conduit 424 and second conduit 426 are enclosed, or radially surrounded, by sealing element 430, which may be formed from, for example, an elastomeric material that swells in the presence of a fluid to form a compressive seal between the external surface of the central conduit 424 and secondary conduit 426 at the interior, and the wall of the wellbore 104 at the exterior. The sealing element 430 may be bounded at each end by end rings 436 that restrict longitudinal expansion of the sealing element 430 as it expands. The end rings 436 may have a cross-section that complements that of the central conduit 424 and second conduit 426, and therefore may have an inner surface that is oval, or resembling two partial-circular portions joined together, with each partial-circular section having a center-point that is offset from the center-point of the other partial-circular section. The end rings 436 may have an external surface that is circular to correspond to the internal wall of the wellbore 104. The sealing element 430 may include one or more (optional) control line passages 428, to facilitate the passages of relatively small diameter control lines that do not effect material additional stresses on the sealing element 430 as it expands.

To facilitate fluid flow across zones, the annular bypass packer 412 may include a bulkhead manifold 414. An exemplary bulkhead manifold 414 is described with regard to FIG. 4A, and is shown as having one or more fluid coupling conduits 432 that are operable to couple to one or more external bypass conduits 416 or other couplings that are external to the packer 412, as shown in FIG. 4. The bulkhead manifold 414 may be formed by machining, casting, or any other suitable fabrication technique, and provides a fluid communication port from the fluid coupling conduits 432 to the second conduit 426. As such, the fluid coupling conduits 432 may feed into, or otherwise transition to, the second conduit 426 to allow fluid flow from the external bypass conduits 416 to the second conduit 426 through the bulkhead manifold 414. The bulkhead manifold 414 may be joined to the first end 420 of the packer 412 by welding or any other suitable joining technique. As shown in FIG. 4A, the bulkhead manifold 414 includes fluid coupling conduits 432 at a first end and a portion of the central conduit 424 at a second end. Through the body of the bulkhead manifold 414, the fluid coupling conduits 432 converge to feed into the second conduit 426 when the bulkhead manifold 414 is joined to the annulus bypass packer 412. In some embodiments, the fluid coupling conduits may converge to a bypass conduit 425 (within the body of the bulkhead manifold 414) having a profile that mates to the second conduit 426 of the annulus bypass packer 412 when the bulkhead manifold 414 is joined to the annulus bypass packer 412 (see, e.g., transition section FIG. 4B).

The external bypass conduits 416 may be used to, for example, convey a fluid from fluid delivery system 114 or from an uphole portion of the annulus 116 across a zone in isolation from other fluid in the annulus 116, thereby isolating a portion of the formation that abuts the relevant zone from the fluid in the external bypass conduits 416. As such, the external bypass conduits 416 may form a portion of the workstring 110 that passes through a production zone 304 (i.e., a second tubing interval 310) by allowing fluid to pass through the external bypass conduits 416 across the production zone without interfering or intermixing with wellbore fluid in the zone, which may be passing from the formation to the primary conduit of the workstring 110 (e.g., through a screen) for collection and production.

Figure 4D:
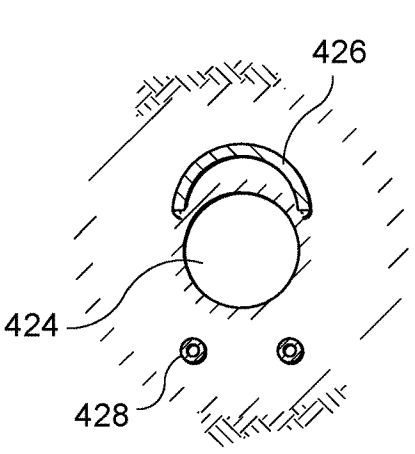
FIG. 4D is a section view, showing a portion of the annular bypass packer of FIG. 4, taken along the lines 4D-4D.

In some embodiments, the second end 422 of the annular bypass packer 412 is configured to deliver fluid from the second conduit 426 to the annulus 116, as shown in FIG. 4D. In such an embodiment, the second conduit 426 may terminate prior to where the central conduit 424 is joined to an adjacent segment of the work string 110. This configuration may be used to, for example, provide fluid communication from a fluid delivery system 114 to the annulus 116 (e.g. at first tubing interval 314) to, for example, pressurize the formation 108 in an injection zone 302.

The packer configuration described above provides an advantage to the annular bypass packer as compared to a traditional swell packer by removing the need for bypass flow tubes (analogous to external bypass conduits 416) to traverse the sealing element of the packer. Such bypass flow tubes may be significantly larger diameter than traditional, relatively small diameter control lines such as 0.25" diameter control lines that are typically used to traverse swell packer sealing elements, as large diameter tubes facilitate a high fluid flow rate that may be necessary to affect reservoir performance. The 0.25", smaller diameter tubes (control lines) are used to house an electrical or glass fiber conductor, or to supply hydraulic fluid to actuate a downhole tool. To provide a traditional packer with the ability to couple to external bypass conduits 416, such traditional swell packers would need to incorporate a relatively large void along the entire length of the packer sealing element, into which a fluid supply conduit (i.e., a flow tube) could be inserted prior to running the packer into the well. Such voids and flow tubes could generate magnified local stress points, ultimately decreasing the reliability or sealing ability of the packer and increasing the amount of rig time needed to install the packer. In the configurations described with regard to FIGS. 4-5, the need for such voids is eliminated in favor of the disclosed annular bypass and manifold system.

Figure 5:
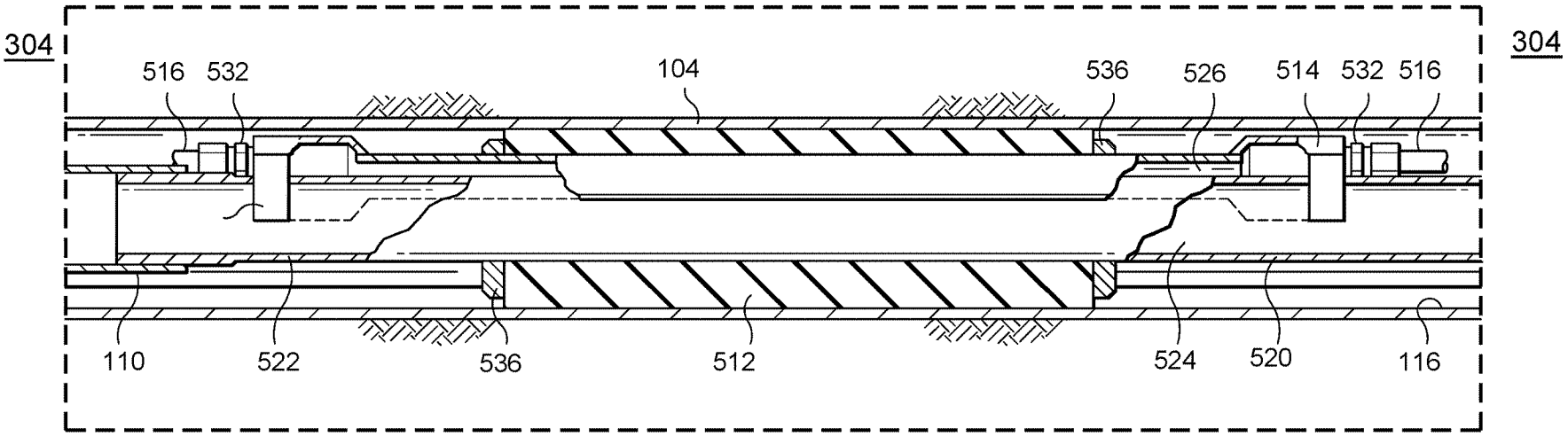
FIG. 5 is a detail view of a dual-manifold annular bypass packer deployed in the production system shown in FIGS. 1-3.

Another embodiment of an annular bypass packer 512 is described with regard to FIG. 5, which depicts a dual-manifold packer 512. In FIG. 5, the annular bypass packer 512 is shown as isolating a production zone 304 from a second production zone 304. The annular bypass packer 512 is otherwise analogous in many respects to the annular bypass packer 412 of FIG. 4. The annular bypass packer 512 includes a central conduit 524, which may be referred to as a first conduit, and is fluidly coupled to a primary flow path of the workstring 110. The central conduit 524 extends from a first end 520 of the annular bypass packer to a second end 522 of the annular bypass packer 512 to convey fluid through the workstring 110. The annular bypass packer 512 also includes a second conduit 526 that is operable to convey fluid along the annulus 116, outside of the primary flow path of the central conduit 524.

Figure 4C:
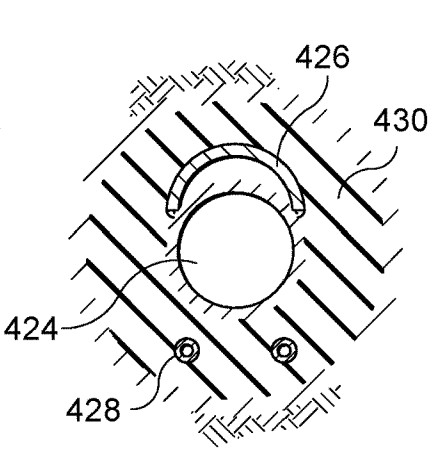
FIG. 4C is a section view, showing a portion of the annular bypass packer of FIG. 4, taken along the lines 4C-4C.
Figure 4B:
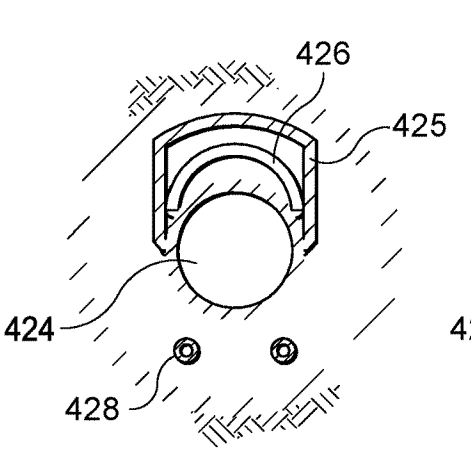
FIG. 4B is a section view, showing a portion of the annular bypass packer of FIG. 4, taken along the lines 4B-4B.
Figure 4A:
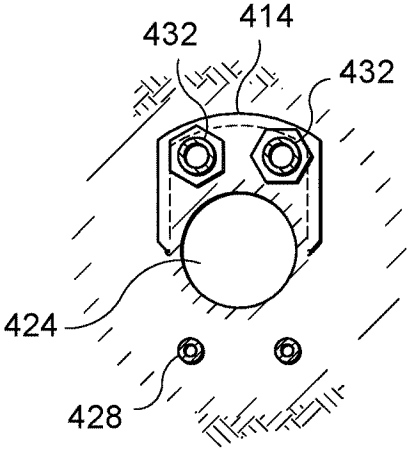
FIG. 4A is a section view, showing a portion of the annular bypass packer of FIG. 4, taken along the lines 4A-4A.

Both the central conduit 524 and second conduit 526 are radially surrounded and enclosed by sealing element 530, which (when activated) may form a compressive seal between the external surface of the central conduit 520 and second conduit 526 at the interior, and the wall of the wellbore 104 at the exterior. The sealing element 530 may include one or more optional control line passages (analogous to line passages 428 of FIG. 4C), to facilitate the passage of relatively small diameter control lines.

To facilitate fluid flow across zones, the annular bypass packer 512 may include a first bulkhead manifold 514 at the first end 520 and a second bulkhead manifold 515 at the second end 522. The first bulkhead manifold may be identical to the bulkhead manifold 414 described above with regard to FIGS. 4 and 4A-4B, and the second bulkhead manifold 515 may be similarly fabricated but oriented at the second end 522 of the annular bypass packer 512 opposite the first bulkhead manifold 514. Each bulkhead manifold may have one or more fluid coupling conduits (analogous to fluid coupling conduits 432 of FIG. 4A) that are operable to couple to one or more external bypass conduits 516 or other couplings that are external to the annular bypass packer 512, as shown in FIG. 5. The first bulkhead manifold 514 and second bulkhead manifold 515 may be formed by machining, casting, or any other suitable fabrication technique, and each provides a fluid communication port from the fluid coupling conduits 532 to the second conduit 526. As such, the fluid coupling conduits 532 may feed into, or otherwise transition to, the second conduit 526 to allow fluid flow from the external bypass conduits 516 (which may be uphole external bypass conduits) to the second conduit 526 from the first bulkhead manifold 514 to the second bulkhead manifold 515 and, in turn, second external bypass conduits 516 (which may be downhole external bypass conduits). Such an arrangement may facilitate flow from, for example, a first production zone to a second production zone.

Figure 6:
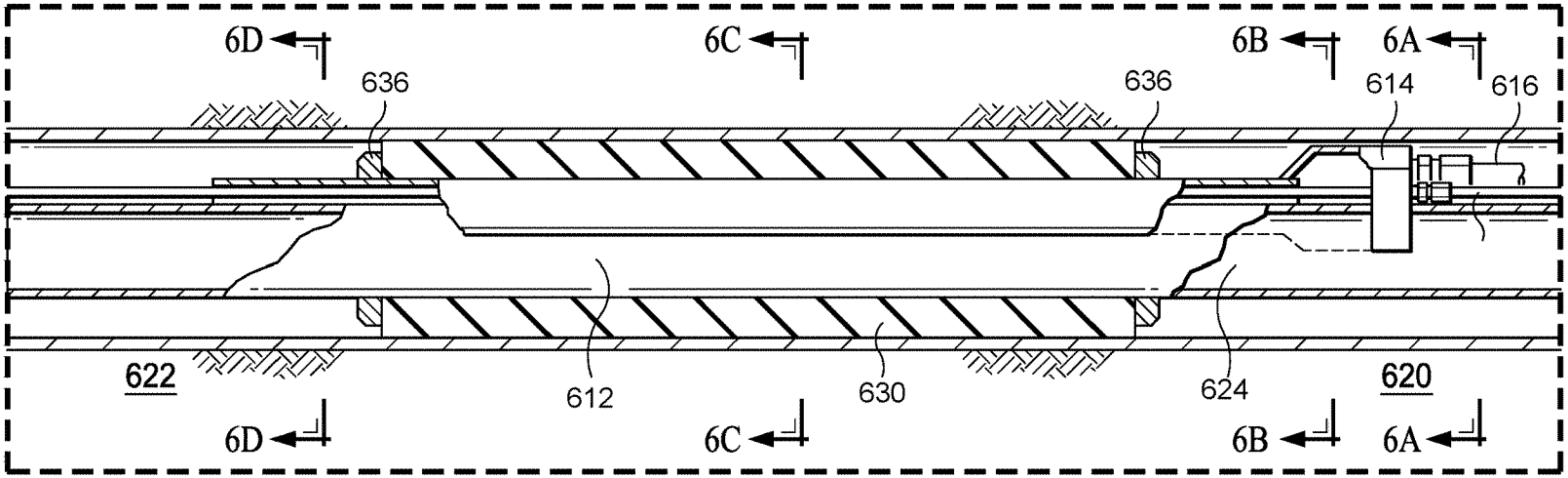
FIG. 6 is a side, cross-section view of an alternative embodiment of a single-manifold annular bypass packer.

Another embodiment of a single manifold bypass packer is shown in FIG. 6 and cross-sections 6A-6D. The annular bypass packer 612 is again shown as isolating a production zone at a first end 620 from an injection zone at a second end 622 of the annular bypass packer 612. The annular bypass packer 612 includes a central conduit 624, which may be referred to as a first conduit that is fluidly coupled to a primary flow path of the workstring 110. The central conduit 624 extends from the first end 620 of the packer to the second end 622 of the packer 612 to convey fluid through the workstring 110. The packer 612 also includes a second conduit 626 that is operable to convey fluid along the annulus 116, outside of the primary flow path (and associated central conduit 624). The second conduit 626 may be formed by enclosing an area that borders the central conduit 624 thereby using an outer boundary of the central conduit 624 to form the second conduit 626. More particularly, the second conduit 626 may be formed by cutting a piece of tubing and joining the cut tubing to an external surface of tubing that forms the primary conduit 624. In some embodiments, the cut tubing may be tubing that has a similar diameter to tubing of the central conduit 624 in half, and seam-welding the half tube to the exterior of the tubing of the central conduit 624.

Both the central conduit 624 and second conduit 626 are enclosed, or radially surrounded, by sealing element 630, which may be formed from, for example, an elastomeric material that swells in the presence of a fluid to form a compressive seal between the external surface of the central conduit 624 and secondary conduit 626 at the interior, and the wall of the wellbore 104 at the exterior. The sealing element 630 may be bounded at each end by end rings 636 that restrict longitudinal expansion of the sealing element 630 as it expands. The end rings 636 may have a cross-section that complements that of the central conduit 624 and second conduit 626, and be therefore be oval, or may have two partial-circular portions joined together, with each partial-circular section having a center-point that is offset from the center-point of the other partial-circular section.

To facilitate fluid flow across zones, the annular bypass packer 612 may include a bulkhead manifold 614. An exemplary bulkhead manifold 614 is described with regard to FIG. 6A, and is shown as having one or more fluid coupling conduits 632 that are operable to couple to one or more external bypass conduits 616, control line conduits 628, or other couplings that are external to the packer 612, as shown in FIG. 6. The bulkhead manifold 614 may be formed by machining, casting, or any other suitable fabrication technique, and provides a fluid communication port from the fluid coupling conduits 632 to the second conduit 626. As such, the fluid coupling conduits 632 may feed into, or otherwise transition to, the second conduit 626 to allow fluid flow from the external bypass conduits 616 to the second conduit 626 through the bulkhead manifold 614. Similarly, in this embodiment, the control line conduits 628 may be routed through the second conduit 626, thereby alleviating the need for any other passages through the swell element of the packer 612.

The bulkhead manifold 614 may be joined to the first end 620 of the packer 612 by welding or any other suitable joining technique. As shown in FIG. 6A, the bulkhead manifold 614 includes fluid coupling conduits 632 at a first end and a portion of the central conduit 624 at a second end. Through the body of the bulkhead manifold 614, the fluid coupling conduits 632 converge to feed into the second conduit 626 when the bulkhead manifold 614 is joined to the annulus bypass packer 612. In some embodiments, the fluid coupling conduits may converge to a bypass conduit 625 (within the body of the bulkhead manifold 614) having a profile that mates to the second conduit 626 of the annulus bypass packer 612 when the bulkhead manifold 614 is joined to the annulus bypass packer 612 (see, e.g., transition section FIG. 6B).

Figure 6D:
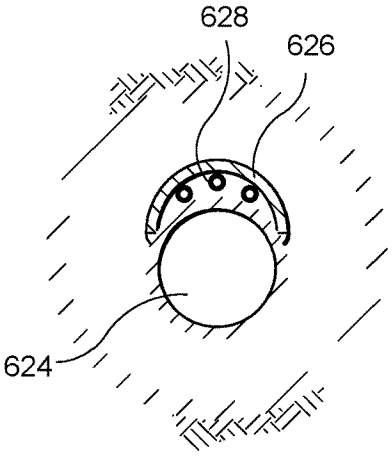
FIG. 6D is a section view, showing a portion of the annular bypass packer of FIG. 6, taken along the lines 6D-6D.
Figure 6C:
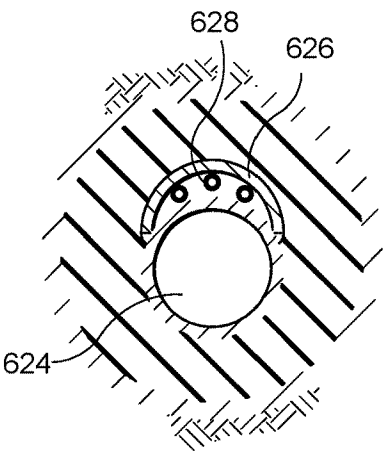
FIG. 6C is a section view, showing a portion of the annular bypass packer of FIG. 6, taken along the lines 6C-6C.
Figure 6B:
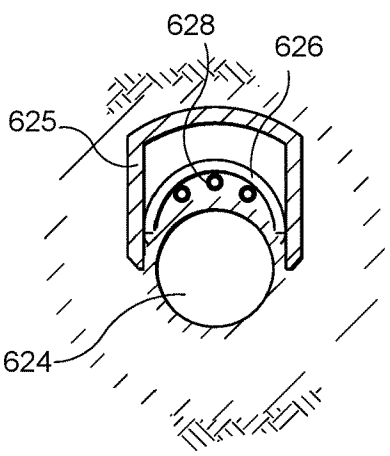
FIG. 6B is a section view, showing a portion of the annular bypass packer of FIG. 6, taken along the lines 6B-6B.
Figure 6A:
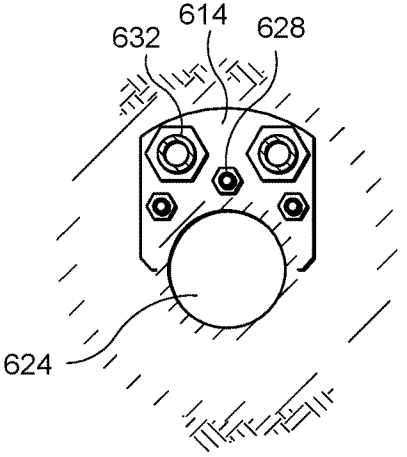
FIG. 6A is a section view, showing a portion of the annular bypass packer of FIG. 6, taken along the lines 6A-6A.

In some embodiments, the second end 622 of the annular bypass packer 612 is configured to deliver fluid from the second conduit 626 to the annulus 116, as shown in FIG. 6D. In such an embodiment, the second conduit 626 may terminate prior to where the central conduit 624 is joined to an adjacent segment of the work string 110. This configuration may be used to, for example, provide fluid communication from a fluid delivery system 114 to the annulus 116 (e.g. at first tubing interval 314) to, for example, pressurize a formation in an injection zone.

In operation, the above-described system may be deployed and operated to simultaneously pressurize and produce from a formation 108. In accordance with an illustrative method, a workstring is deployed to a wellbore in a manner such that packers, such as packers 412 or 512 described above, isolate the various zones of the wellbore 104, including production zones 304 and injection zones 302, as described with regard to FIG. 3, and isolation zones (not shown). As referenced herein, isolation zones are segments of the wellbore that are fluidly isolated from the production zones 304 and injection zones 302. The fluid supply source 114 may be operated to supply a pressurized fluid to the annulus 116 of the wellbore 104 at injection zones 302.

To facilitate the application of the pressurized fluid, an injection fluid may be supplied via the annulus 116 to external bypass conduits (such as external bypass conduits 416 and 516) that traverse the production zones 304. The injection fluid may be conveyed from the production zones 304 to the injection zones 302 using the annular bypass packers 412 described above, which may be alternatingly positioned and oriented to transfer the injection fluid from the annulus 116 to the fluid supply lines 416 that traverse the production zones 304 and back at the injection zones 302, the injection fluid is in equilibrium with the annulus of the wellbore, thereby injecting fluid to the formation. Simultaneously, hydrocarbon-bearing fluid may be extracted from the formation 108 at the production zones 304, where the workstring may be screened or otherwise opened to allow the passage of fluid from the formation to the central conduit of the workstring 110 via the annulus 116.

A reverse embodiment is also contemplated, in which the flow directions described above may be reversed, such that an injection fluid may be supplied via the central conduit of the workstring 110 through screened or similar vented segments that traverse the injection zones. Correspondingly, production fluid may be harvested via external bypass conduits (such as external bypass conduits 416 and 516) that traverse the annulus 116 within injection (or isolation) zones. In such an embodiment, production fluid may be conveyed from the production zones toward the surface for collection using the annular bypass packers 412 described above, which may be alternatingly positioned and oriented to transfer the production fluid from the annulus 116 to fluid supply lines 416 that traverse injection zones.

It should be apparent from the foregoing that embodiments of an invention having significant advantages have been provided. While the embodiments are shown in only a few forms, the embodiments are not limited but are susceptible to various changes and modifications without departing from the spirit thereof. As such, the present disclosure should be understood to cover at least the following examples:

Example 1

A packer comprising: a first conduit extending from a first end of the packer to a second end of the packer; a second conduit adjacent to the first conduit, wherein a portion of the second conduit is formed by an outer surface of the first conduit; and a swelling element surrounding the first conduit and second conduit. The first end of the packer comprises a bulkhead manifold having a transition section forming a fluid coupling from at least one external conduit to the second conduit, and the swelling element is operable to form a seal against a wellbore wall upon exposure to a fluid.

Example 2

The packer of example 1, wherein the bulkhead manifold comprises a transition portion fluidly coupling the second conduit to an external bypass conduit.

Example 3

The packer of example 1, wherein the external bypass conduit comprises a small-diameter control line.

Example 4

The packer of example 1, wherein the bulkhead manifold is a first bulkhead manifold, and wherein the second end of the packer comprises a second bulkhead manifold.

Example 5

The packer of example 1, further comprising an end ring coupled to the swelling element of the packer and operable to limit the longitudinal expansion of the swelling element, wherein the swelling element has an internal profile that complements the external profile of the first conduit and the second conduit.

Example 6

The packer of example 1, wherein the first conduit comprises a first tubing segment, and wherein the second conduit comprises a portion of a second tubing segment that is joined to the first tubing segment.

Example 7

The annular bypass packer of example 6, wherein the second tubing segment is seam-welded to the first tubing segment.

Example 8

A system for providing fluid flow to a wellbore, the system comprising: a fluid supply source fluidly coupled to an annulus of a wellbore; and a packer. The packer has (1) a first conduit extending from a first end of the packer to a second end of the packer; (2) a second conduit adjacent to the first conduit, wherein a portion of the second conduit is formed by an outer surface of the first conduit; and (3) a swelling element surrounding the first conduit and second conduit, wherein the first end of the packer comprises a bulkhead manifold having a transition section forming a fluid coupling from at least one external conduit to the second conduit, and wherein the swelling element is operable to form a seal against a wellbore wall upon exposure to a wellbore fluid. The first end of the packer is fluidly coupled to the fluid supply source via an external bypass conduit.

Example 9

The system of example 8, wherein the second conduit is fluidly coupled to the annulus of the wellbore at the second end of the packer.

Example 10

The system of example 8, wherein the bulkhead manifold comprises a transition portion fluidly coupling the second conduit to an external bypass conduit.

Example 11

The system of example 8, wherein the first conduit comprises a first tubing segment, and wherein the second conduit is formed by an outer surface of the first tubing segment and an internal portion of a second tubing segment that is joined to the first tubing segment.

Example 12

The system of example 11, wherein the second tubing segment is seam-welded to the first tubing segment.

Example 13

The system of example 8, wherein the packer comprises a plurality of first packers, and further comprising a plurality of second packers.

Example 14

The system of example 13, wherein the bulkhead manifold of each of the first plurality of annular bypass packers is fluidly coupled to an external bypass conduit extending through a production zone.

Example 15

The system of example 13, wherein the second end of each of the first plurality of annular bypass packers is fluidly coupled to the annulus of the wellbore at an injection zone.

Example 16

The system of example 13, wherein the bulkhead manifold of each of the plurality of second packers is fluidly coupled to an external bypass conduit extending through a production zone, and wherein an opposing end of each of the plurality of second packers is fluidly coupled to an injection zone.

Example 17

The system of example 13, wherein the bulkhead manifold of each of the first plurality of annular bypass packers is fluidly coupled to an external bypass conduit extending through one of an isolation zone or an injection zone.

Example 18

The system of example 13, wherein the second end of each of the first plurality of annular bypass packers is fluidly coupled to the annulus of the wellbore at a production zone.

Example 19

The system of example 13, wherein the bulkhead manifold of each of the plurality of second packers is fluidly coupled to an external bypass conduit extending through an injection zone, and wherein an opposing end of each of the plurality of second packers is fluidly coupled to a production zone.

Example 20

The system of example 8, wherein the bulkhead manifold assembly is a first bulkhead manifold, and wherein the second end of the packer comprises a second bulkhead manifold, and wherein the external bypass conduit is a first external bypass conduit, and wherein the second bulkhead manifold is coupled to a second, downhole external bypass conduit.

Example 21

The system of example 20, wherein the packer comprises a plurality of packers, and wherein each first end of a packer is coupled to a first external bypass conduit extending through an uphole isolation zone and wherein each second end of a packer is coupled to a second external bypass conduit extending into a downhole isolation zone.

Example 22

A method of providing fluid flow to a wellbore, the method comprising: supplying a fluid to an annulus of a wellbore from a fluid supply source; and supplying fluid to a first end of an annular bypass packer. The annular bypass packer includes: (1) a first conduit extending from the first end of the packer to a second end of the packer; (2) a second conduit adjacent to the first conduit, wherein a portion of the second conduit is formed by an outer surface of the first conduit; and (3) a swelling element surrounding the first conduit and second conduit, wherein the first end of the packer comprises a bulkhead manifold assembly having a transition section forming a fluid coupling from at least one external conduit to the second conduit, and wherein the swelling element is operable to form a seal against a wellbore wall upon exposure to a wellbore fluid. The first end of the packer is fluidly coupled to the fluid supply source via an external bypass conduit.

Example 23

The method of example 22, wherein the second conduit is fluidly coupled to an injection zone of the wellbore at the second end of the packer.

Example 24

The method of example 22, wherein the bulkhead manifold comprises a transition portion fluidly coupling the second conduit to an external bypass conduit.

Example 25

The method of example 22, wherein the first conduit comprises a first tubing segment, and wherein the second conduit is formed by an outer surface of the first tubing segment and an internal portion of a second tubing segment that is joined to the first tubing segment.

Example 26

The method of example 25, wherein the second tubing segment is seam-welded to the first tubing segment.

Example 27

The method of example 22, wherein the packer comprises a plurality of first packers, and further comprising a plurality of second packers.

Example 28

The method of example 27, wherein the bulkhead manifold of each of the plurality of first packers is fluidly coupled to an external bypass conduit extending through a production zone.

Example 29

The method of example 27, wherein the second end of each of the plurality of first packers is fluidly coupled to an injection zone.

Example 30

The method of example 27, wherein the bulkhead manifold of each of the plurality of second packers is fluidly coupled to an external bypass conduit extending through a production zone, and wherein an uphole end of each of the plurality of second packers is fluidly coupled to an injection zone.

Example 31

The method of example 27, wherein the bulkhead manifold of each of the plurality of first packers is fluidly coupled to an external bypass conduit extending through one of an isolation zone and an injection zone.

Example 32

The method of example 27, wherein the second end of each of the plurality of first packers is fluidly coupled to a production zone.

Example 33

The method of example 27, wherein the bulkhead manifold of each of the plurality of second packers is fluidly coupled to an external bypass conduit extending through an injection zone, and wherein an uphole end of each of the plurality of second packers is fluidly coupled to a production zone.

Example 34

The method of example 22, wherein the bulkhead manifold is a first bulkhead manifold, and wherein the second end of the packer comprises a second bulkhead manifold, and wherein the external bypass conduit is a first external bypass conduit, and wherein the second bulkhead manifold is coupled to a second, downhole external bypass conduit.

Example 35

The method of example 34, wherein the packer comprises a plurality of packers, and wherein each the first end of a packer is coupled to a first external bypass conduit extending through an uphole isolation zone and the second end of each packer is coupled to a second external bypass conduit extending into a downhole isolation zone.

I claim:

1. A packer comprising:

a first conduit extending from a first end of the packer to a second end of the packer;

a second conduit adjacent to the first conduit, wherein a portion of the second conduit is formed by an outer surface of the first conduit; wherein the first conduit comprises a first tubing segment, and wherein the second conduit comprises a portion of a separate second tubing segment that is joined to the first tubing segment; and a swelling element surrounding the first conduit and the second conduit, wherein the first end of the packer comprises a bulkhead manifold having a transition section forming a fluid coupling from at least one external conduit to the second conduit, wherein the bulkhead manifold comprises a transition portion fluidly coupling the second conduit to an external bypass conduit that is also aligned with the second conduit, wherein the external bypass conduit and the second conduit form a longitudinal passage along the first conduit and through the packer, and wherein the swelling element is operable to form a seal against a wellbore wall upon exposure to a fluid.

2. The packer of claim 1, wherein the external bypass conduit comprises a small-diameter control line.

3. The packer of claim 1, wherein the bulkhead manifold is a first bulkhead manifold, and wherein the second end of the packer comprises a second bulkhead manifold.

4. The packer of claim 1, further comprising an end ring coupled to the swelling element of the packer and operable to limit the longitudinal expansion of the swelling element, wherein the swelling element has an internal profile that complements the external profile of the first conduit and the second conduit.

5. The packer of claim 1, wherein the second tubing segment is seam-welded to the first tubing segment.

6. The packer of claim 1, wherein the swelling element comprises an elastomer.

7. A system for providing fluid flow to a wellbore, the system comprising:

a fluid supply source fluidly coupled to an annulus of a wellbore; and a packer having: a first conduit extending from a first end of the packer to a second end of the packer; a second conduit adjacent to the first conduit, wherein a portion of the second conduit is formed by an outer surface of the first conduit; wherein the first conduit comprises a first tubing segment, and wherein the second conduit comprises a portion of a separate second tubing segment that is joined to the first tubing segment; and a swelling element surrounding the first conduit and the second conduit, wherein the first end of the packer comprises a bulkhead manifold having a transition section forming a fluid coupling from at least one external conduit to the second conduit, wherein the bulkhead manifold comprises a transition portion fluidly coupling the second conduit to an external bypass conduit that is also aligned with the second conduit, wherein the external bypass conduit and the second conduit form a longitudinal passage along the first conduit and through the packer, and wherein the swelling element is operable to form a seal against a wellbore wall upon exposure to a wellbore fluid; and wherein the first end of the packer is fluidly coupled to the fluid supply source via the external bypass conduit.

8. The system of claim 7, wherein the second conduit is fluidly coupled to the annulus of the wellbore at the second end of the packer.

9. The system of claim 7, wherein the second conduit is formed by an outer surface of the first tubing segment and an internal portion of the separate second tubing segment that is joined to the first tubing segment.

10. The system of claim 7, wherein the packer comprises a plurality of first packers, and further comprising a plurality of second packers.

11. The system of claim 10, wherein the bulkhead manifold of each of the plurality of second packers is fluidly coupled to the external bypass conduit extending through a production zone, and wherein an opposing end of each of the plurality of second packers is fluidly coupled to an injection zone.

12. The system of claim 10, wherein the bulkhead manifold of each of the plurality of second packers is fluidly coupled to the external bypass conduit extending through an injection zone, and wherein an opposing end of each of the plurality of second packers is fluidly coupled to a production zone.

13. The system of claim 7, wherein the bulkhead manifold is a first bulkhead manifold, and wherein the second end of the packer comprises a second bulkhead manifold, and wherein the external bypass conduit is a first external bypass conduit, and wherein the second bulkhead manifold is coupled to a second, downhole external bypass conduit.

14. The system of claim 7, wherein the swelling element comprises an elastomer.

15. A method of providing fluid flow to a wellbore, the method comprising:

supplying a fluid to an annulus of a wellbore from a fluid supply source; and supplying fluid to a first end of an annular bypass packer having: a first conduit extending from the first end of the packer to a second end of the packer; a second conduit adjacent to the first conduit, wherein a portion of the second conduit is formed by an outer surface of the first conduit; wherein the first conduit comprises a first tubing segment, and wherein the second conduit comprises a portion of a separate second tubing segment that is joined to the first tubing segment; and a swelling element surrounding the first conduit and the second conduit, wherein the first end of the packer comprises a bulkhead manifold having a transition section forming a fluid coupling from at least one external conduit to the second conduit, wherein the bulkhead manifold comprises a transition portion fluidly coupling the second conduit to an external bypass conduit that is also aligned with the second conduit, wherein the external bypass conduit and the second conduit form a longitudinal passage along the first conduit and through the packer, and wherein the swelling element is operable to form a seal against a wellbore wall upon exposure to a wellbore fluid; and wherein the first end of the packer is fluidly coupled to the fluid supply source via the external bypass conduit.

16. The method of claim 15, wherein the second conduit is formed by an outer surface of the first tubing segment and an internal portion of the separate second tubing segment that is joined to the first tubing segment.

17. The method of claim 15, wherein the packer comprises a plurality of first packers, and further comprising a plurality of second packers, and wherein the bulkhead manifold of each of the plurality of second packers is fluidly coupled to the external bypass conduit extending through a production zone, and wherein an uphole end of each of the plurality of second packers is fluidly coupled to an injection zone.

18. The method of claim 15, wherein the bulkhead manifold is a first bulkhead manifold, and wherein the second end of the packer comprises a second bulkhead manifold, and wherein the external bypass conduit is a first external bypass conduit, and wherein the second bulkhead manifold is coupled to a second, downhole external bypass conduit.

19. The method of claim 18, wherein the packer comprises a plurality of packers, and wherein the first end of each packer is coupled to a first external bypass conduit extending through an uphole isolation zone and the second end of each packer is coupled to a second external bypass conduit extending into a downhole isolation zone.

20. The method of claim 15, wherein the swelling element comprises an elastomer.

* * * * *